US010024590B2

(12) United States Patent
Bahar

(10) Patent No.: US 10,024,590 B2
(45) Date of Patent: Jul. 17, 2018

(54) ELECTROCHEMICAL COMPRESSOR REFRIGERATION APPARTUS WITH INTEGRAL LEAK DETECTION SYSTEM

(71) Applicant: Xergy Inc., Georgetown, DE (US)

(72) Inventor: Bamdad Bahar, Georgetown, DE (US)

(73) Assignee: Xergy Inc., Harrington, DE (US)

( * ) Notice: Subject to any disclaimer, the term of this patent is extended or adjusted under 35 U.S.C. 154(b) by 0 days.

(21) Appl. No.: 15/418,851

(22) Filed: Jan. 30, 2017

(65) Prior Publication Data

US 2017/0138653 A1 May 18, 2017

Related U.S. Application Data

(63) Continuation-in-part of application No. 13/725,515, filed on Dec. 21, 2012, now Pat. No. 9,738,981.
(Continued)

(51) Int. Cl.
*F25B 49/00* (2006.01)
*F25B 31/00* (2006.01)
(Continued)

(52) U.S. Cl.
CPC ..... *F25B 49/005* (2013.01); *C25B 9/00* (2013.01); *F25B 31/00* (2013.01); *F25B 49/022* (2013.01); *F25B 2500/222* (2013.01)

(58) Field of Classification Search
CPC ..... F25B 49/005; F25B 31/00; F25B 49/022; F25B 2500/222; C25B 9/00
See application file for complete search history.

(56) References Cited

U.S. PATENT DOCUMENTS 1,925,281 A 3/1934 Ranque
2,913,511 A 11/1959 Grubb, Jr.
(Continued)

FOREIGN PATENT DOCUMENTS

GB 235009 A 10/2016
WO 9106691 5/1991
(Continued)

OTHER PUBLICATIONS

"Engineering a Membrane Electrode Assembly," John W. Weidner et al., The Electrochemical Society Interface, Winter, 2003, pp. 40-43.

(Continued)

*Primary Examiner* — Emmanuel Duke
(74) *Attorney, Agent, or Firm* — Invention To Patent Services; Alex Hobson

(57) ABSTRACT

An electrochemical compressor system, such as an electrochemical refrigeration system includes a sealed vessel that reduces leak issues related to the electrochemical cell. The sealed vessel may be molded or formed from a polymer or a composite polymer having reinforcing materials, such as fibers therein. The sealed vessel may be plated with metal to reduce gas permeation through the wall of the vessel and to accommodate and improve the attachment of conduits, including metal conduits thereto. A metal conduit may be brazed onto a vessel and the brazing material may be selected for polymer to metal joining and for reduced contamination potential of the system. The electrochemical compressor system incorporates a leak sensor configured at least partially within the sealed rigid vessel that measures the pressure within the vessel.

20 Claims, 1 Drawing Sheet

Related U.S. Application Data

(60) Provisional application No. 61/630,960, filed on Dec. 21, 2011, provisional application No. 62/288,415, filed on Jan. 28, 2016.

(51) Int. Cl.
*F25B 49/02* (2006.01)
*C25B 9/00* (2006.01)

(56) References Cited

U.S. PATENT DOCUMENTS

| | | | | |
|---|---|---|---|---|
| 3,544,377 | A | 3/1967 | Justi et al. | |
| 3,432,355 | A | 3/1969 | Niedrach et al. | |
| 3,489,670 | A | 1/1970 | Maget | |
| 4,118,299 | A | 10/1978 | Maget | |
| 4,402,817 | A | 9/1983 | Maget | |
| 4,523,635 | A | 6/1985 | Nishizaki et al. | |
| 4,593,534 | A * | 6/1986 | Bloomfield | F25B 1/00 417/48 |
| 4,829,785 | A | 5/1989 | Hersey | |
| 4,990,412 | A * | 2/1991 | Hersey | F25B 9/02 204/DIG. 4 |
| 5,024,060 | A | 6/1991 | Trusch | |
| 5,547,551 | A | 8/1996 | Bahar et al. | |
| 5,599,614 | A | 2/1997 | Bahar et al. | |
| 5,635,041 | A | 6/1997 | Bahar et al. | |
| 5,746,064 | A | 5/1998 | Tsenter | |
| 5,768,906 | A | 6/1998 | Tsenter | |
| 5,900,031 | A | 5/1999 | Bloomfield | |
| 5,961,813 | A | 10/1999 | Getermann et al. | |
| 5,976,724 | A | 11/1999 | Bloomfield | |
| 59,993,619 | | 11/1999 | Bloomfield et al. | |
| 6,068,673 | A | 5/2000 | Bloomfield | |
| 6,167,721 | B1 | 1/2001 | Tsenter | |
| 6,254,978 | B1 | 7/2001 | Bahar et al. | |
| 6,321,561 | B1 * | 11/2001 | Maget | F03G 7/005 417/379 |
| 6,425,440 | B1 | 7/2002 | Tsenter et al. | |
| 6,553,771 | B2 | 4/2003 | Tsenter | |
| 6,635,384 | B2 | 10/2003 | Bahar et al. | |
| 6,994,929 | B2 | 2/2006 | Barbir et al. | |
| 8,640,492 | B2 | 2/2014 | Bahar | |
| 8,769,972 | B2 | 7/2014 | Bahar | |
| 9,005,411 | B2 | 4/2015 | Bahar et al. | |
| 2002/0066277 | A1 | 6/2002 | Tsenter | |
| 2003/0141200 | A1 | 7/2003 | Harada | |
| 2003/0155252 | A1 | 8/2003 | Juda et al. | |
| 2003/0196893 | A1 | 10/2003 | Mcelroy et al. | |
| 2004/0040862 | A1 | 3/2004 | Kosek | |
| 2004/0142215 | A1 | 7/2004 | Barbir et al. | |
| 2005/0072688 | A1 | 4/2005 | Melster | |
| 2005/0274138 | A1 | 12/2005 | Golden | |
| 2006/0230765 | A1 | 10/2006 | Fedorov et al. | |
| 2006/0254286 | A1 | 11/2006 | Johnson et al. | |
| 2008/0187794 | A1 | 8/2008 | Weingaetner | |
| 2009/0214905 | A1 | 8/2009 | Narayanan et al. | |
| 2009/0308752 | A1 | 12/2009 | Evans et al. | |
| 2010/0132386 | A1 | 6/2010 | Bahar | |
| 2011/0108246 | A1 * | 5/2011 | Bahar | F25B 1/00 165/104.28 |
| 2011/0198215 | A1 | 8/2011 | Bahar | |
| 2011/0256463 | A1 | 10/2011 | Michalske et al. | |
| 2017/0138653 | A1 | 5/2017 | Bahar | |

FOREIGN PATENT DOCUMENTS

| | | | |
|---|---|---|---|
| WO | 0125700 | A1 | 4/2001 |
| WO | 007108 | A1 | 1/2008 |
| WO | WO2008154984 | A1 | 12/2008 |
| WO | 2010127270 | A2 | 4/2010 |
| WO | WO2010127270 | A2 | 11/2010 |
| WO | 2013096890 | A1 | 6/2013 |

OTHER PUBLICATIONS

Technical Specifications for "HOGEN Hydrogen Generation Systems," Proton Energy Systems, Inc., Oct. 2008, 2 pages.

"Teledyne Titan(TM) HM Generator Series Hydrogen/Oxygen Gas Systems," Teledyne Energy Systems, Inc., Jun. 2007, 2 pages.

"A Comparative Study of Water as a Refrigerant with Some Current Refrigerants", International Journal of Energy Research, Int. J. energy res. 2005: 29.947-959.

* cited by examiner

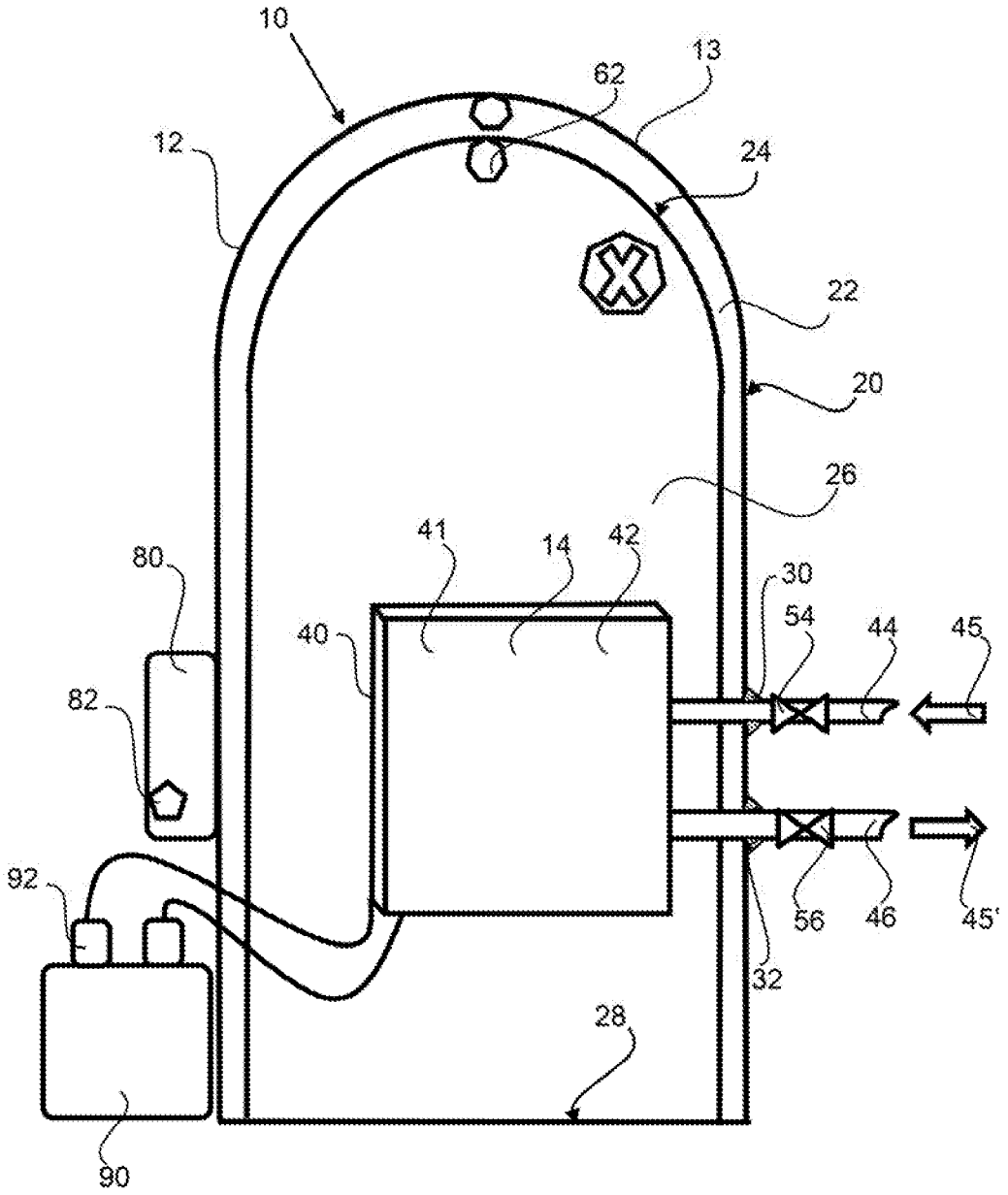
10
62
13
12
24
22
20
26
41
14
42
80
30
54
44
45
40
82
92
56
46
45'
32
28
90

ELECTROCHEMICAL COMPRESSOR REFRIGERATION APPARTUS WITH INTEGRAL LEAK DETECTION SYSTEM

CROSS REFERENCE TO RELATED APPLICATIONS

This application is a continuation in part of U.S. application Ser. No. 13/725,515 filed on Dec. 21, 2012, entitled Electrochemical Compression System and currently pending, which claims the benefit of U.S. provisional application No. 61/630,960, filed on Dec. 21, 2011, and this application claims the benefit of U.S. provisional application No. 62/288,415, filed on Jan. 28, 2016; the entirety of each application listed is hereby incorporated by reference herein.

STATEMENT OF GOVERNMENT LICENSE RIGHTS

This invention was made with government support under Department of Energy grant DE-SC0009636. The government has certain rights in the invention.

BACKGROUND OF THE INVENTION

Field of the Invention

This application relates to electrochemical compressor refrigeration systems having integral leak detection systems.

Background

Electrochemical compressors are a disruptive and transformational technology, and are poised for wide scale commercialization within consumer appliances such as hybrid hot water heaters and air conditioners. The impact of improved efficiency provided by these systems is very significant. However, none of the benefits of this technology can be realized without wide scale consumer adoption. Conventional compressors and refrigeration systems are typically sold with multi-year warranties. Therefore, electrochemical compressors and refrigeration systems employing electrochemical compressors must operate without issues in order to gain wide scale consumer acceptance. Conventional refrigeration systems routinely have refrigerant, such as Freon, leakage issues. Refrigerant leakage continues to be a critical issue for conventional refrigeration systems after more than 100 years of adoption of this technology.

Electrochemical compressors can be employed in a variety of different refrigeration cycles depending on the appliance application. Electrochemical compressors may utilize a variety of types and compositions of working fluids and these working fluids may comprise or consists essentially of hydrogen. Hydrogen is the lightest element, with higher molecular speed and lower viscosity than any other gas. As a result, it has the highest leakage rate of any gas. Hydrogen can also be difficult to detect because it is lighter than air and diffuses rapidly. Traditional electrochemical compressors designs involve multiple cells connected in series which provides literally hundreds of linear feet of bipolar plate surfaces that require sealing. In addition, some electrochemical compressors refrigeration systems involve the use of water as a co-refrigerant, which can result in reactions with materials. Water may degrade joints and seals, and more concerning, can contribute to metal ion dissolution in the water which in turn can contaminate the membranes. As compressor pressures increase, the potential for leakage with so much length of sealing surfaces increases exponentially. Ensuring long-term leak free service is a potential Achilles heel for electrochemical compressors technology if not addressed.

SUMMARY OF THE INVENTION

This invention is directed to providing advanced techniques and methods for the joining of tubes, compressors, heat exchangers as well as new concepts for vessel electrochemical compressors to eliminate hydrogen leakage. In an exemplary embodiment, the electrochemical compressor system comprises in-situ and continuous leak detection to assure safe long-term service.

As described in U.S. patent application Ser. No. 13/725,515 to Naugler, entitled Electrochemical Compression System, hereby incorporated by reference herein, an electrochemical compressor is contained within a vessel having a single sealing surface that can be hermetically sealed. The vessel or vessel described would have a single versus multiple sealing surfaces, however, even with one sealing surface, that surface or connection between the components of the vessel and other connecting joints in the system, outside the container, must be absolutely hermetically sealed without any long-term degradation. Material selection for the tubes and vessel is limited to essentially aluminum, certain types of steel and engineered polymers.

Aluminum tubing is widely available, and a good alternative to copper. Aluminum joints are typically brazed. However, brazing materials must not have trace contaminants such as typically zinc or cesium with Aluminum. Described herein is a unique method to first optionally plate the sealing surfaces with Chromium, and then braze the contact surface. A 718 Aluminum alloy with 12% silicon is proposed for the joint brazing material. A custom flux material without Zinc, but with small quantity of Cesium Fluoroaluminates, CsAlF, is provided where the flux alloy is designed to be burnt off during the brazing process; with melt temperatures exceeding 577° C. (1070° F.). Aluminum brazing systems have been employed in the Auto industry, but none of them are suitable for electrochemical compression systems and none have been developed and tested for long-term service in consumer appliances utilizing electrochemical compression. Proper hermetic sealing qualification requires that the sealed joints be tested for integrity, under pressure, under vibration, and under thermal cycling to ensure long-term performance.

In addition to providing these advanced brazing techniques, a novel advanced hybrid or composite sealed vessel made from polymeric compounds that can be molded or optionally produced using composite fiber reinforced thermoset engineering polymers or both, as described herein. Composite hybrid vessels are not considered for applications with traditional refrigerants, chlorofluorocarbon (CFC's) and hydro-fluorocarbon (HFC's), since these refrigerants will degrade most polymers leading to fracture of the vessel under the vibration and pressures needed for typical compressor operation. However electrochemical compressors produce little to no vibration and organic compounds will not degrade a polymer or composite hybrid vessel material, making these versatile materials options for these systems. The polymer or composite vessel materials provide excellent sealing surfaces and provide significant benefits in terms of overall system weight reduction from conventional metal materials. It is important to note, that in an exemplary embodiment a composite vessel may be mated with metal components in order to connect to the balance of the refrigeration system. In an exemplary embodiment, the sealed vessel is a metal-composite hybrid, with metal components inserted where necessary, such as through the wall of the vessel for the delivery of working fluid to the electrochemical cell.

In conjunction with the leak prevention system provided herein, an in-situ technology for leak detection is described. Traditionally, leak testing has been carried out by immersing the units in water, filling them with pressurized nitrogen, and then watching for bubbles. While generally effective, this method is relatively cumbersome and messy, and is not always 100 percent effective nor continuous. Current electronic gas detectors, once installed, require regularly scheduled calibration and maintenance. There are many other methods of low cost leak detection including thermal detection, catalytic combustion of hydrogen, ultrasonic leak detection, glow plugs and heat sensors, semi-conducting Oxide sensors that rely on surface effects with a minimum oxygen concentration, and chemically active, or chemochromic, materials form the basis novel thin films or "smart coatings" that change color upon contact with hydrogen.

In this novel vessel concept, or optionally in the refrigerant loop outside the vessel, an in-situ sensor is provided that can detect and communicate any abnormal pressure loss or leak. Thus, a low cost, robust, and continuous system is provided that can be integrated into the compressor vessel design or system. Direct leak detection methods have the benefit that they can be connected to a facility's energy management system to enable remote monitoring and notification.

In an exemplary embodiment, an electrochemical system comprises an electrochemical compressor connected to an electrical power supply at a potential and through which a working fluid that includes a component that primarily acts as an electrochemically-active component flows. The electrochemical compressor has an inlet and outlet and one or more electrochemical cells. Each electrochemical cell has an anode connected to the electrical power supply, a cathode connected to the electrical power supply, and an electrolyte disposed between and in intimate electrical contact with the cathode and the anode to pass at least a portion of the working fluid between the anode to the cathode. An inlet conduit supplies the working fluid to the electrochemical cell at a first pressure, the working fluid, or a portion thereof is pumped through the electrolyte by an electrical potential across the anode and cathode to produce a working fluid at a second pressure that is at a higher pressure than said first pressure. The working fluid then flows out of the outlet conduit to produce work.

The electrochemical compressor is configured with a sealed rigid vessel having an interior volume. A vessel wall creates the sealed interior volume that may be hermetically sealed. The vessel wall may comprise an outer wall and an inner wall, and a void space may be between the outer and inner walls. A vessel wall may be made out of or comprise a polymer, such as a fluoropolymer including but not limited to polytetrafluoroethylene, fluorinated ethylene propylene, THV, PFA and the like. A vessel wall may consist substantially of a polymer when the wall composition is at least 90% polymer. A vessel wall may comprise, consist substantially of or consist only of a thermoset polymer, such as polyimide or polyamide. A vessel wall may be a composite wall and comprise a reinforcing material in a polymer, such as fibers including but not limited to carbon fibers, metal fibers, natural fibers, fiberglass fibers, and the like. A composite or polymer wall may be metallized to reduce permeation of gasses through the polymer wall and may comprise an aluminum metalized surface, such as through vapor deposition of the metal to the interior and/or the exterior surface of the vessel wall.

A vessel may be made out of metal or comprise metal and the inlet and outlet conduits may be brazed to the vessel wall, as described herein. The brazing material may comprise an aluminum alloy such as aluminum and silicon. The vessel wall may be coated with chromium, around a seal region, prior to the metal conduit being brazed thereto. The sealed surface may contain no zinc.

The summary of the invention is provided as a general introduction to some of the embodiments of the invention, and is not intended to be limiting. Additional example embodiments including variations and alternative configurations of the invention are provided herein.

BRIEF DESCRIPTION OF THE DRAWINGS

The accompanying drawings are included to provide a further understanding of the invention and are incorporated in and constitute a part of this specification, illustrate embodiments of the invention, and together with the description serve to explain the principles of the invention.

FIG. 1 shows an exemplary electrochemical system comprising a sealed rigid vessel and inlet and outlet conduits to the electrochemical compressor.

DETAILED DESCRIPTION OF THE ILLUSTRATED EMBODIMENTS

Corresponding reference characters indicate corresponding parts throughout the several views of the FIGURES. The FIGURES represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

As used herein, the terms "comprises." "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying FIGURES. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

As shown in FIG. 1, an exemplary electrochemical system 10 comprises a sealed rigid vessel 12 and inlet conduit 44 and outlet conduit 46 to the electrochemical compressor 14 comprising one or more electrochemical cells 41. An inlet flow of working fluid 45 flows through the inlet conduit 44, through the vessel wall 13 to the electrochemical compressor at a first pressure. An outlet flow of working fluid 45' flows out of the electrochemical compressor, through the vessel wall 13 at a second pressure that is higher than the first pressure. The vessel wall is comprised of an outer wall 20 and an inner wall 24 and there is a void space 22 therebetween. A leak sensor 62 is configured to measure the concentration of a working fluid, or the electrochemical active component of the working fluid, such as hydrogen in this void space. There is also a leak sensor in the interior volume 26 of the sealed rigid vessel configured to measure the concentration of a working fluid, or the electrochemical active component of the working fluid, such as hydrogen. The electrochemical cell is connected to a power supply 90, a battery having terminals 92. It is to be appreciated that the electrochemical cell may be connected to a line power supply, such as through an outlet connection and a control module may regulate the potential across the anode 40 and cathode 42 of the electrochemical cell. A control system 80 comprises a micro-processor that controls the potential across the electrochemical cell. The control system may receive signals from the leak sensors when an upper threshold limit of the working fluid is detected and the controller may change the potential across the cell to mitigate this elevated concentration, such as by increasing the potential to react the electrochemically active component of the working fluid or reducing the potential and/or the flow of working fluid into the cell by adjusting the inlet valve 54 or outlet valve 56.

The inlet conduit 44 and/or the outlet conduit 46 may be sealed to the vessel wall 13 by the brazing techniques described herein to produce a brazed seal 30 containing a brazing material 32

The composite vessel containing a complete electrochemical refrigeration system described herein may require validation including product integrity testing under a variety of conditions including, but not limited to, impact testing, projectile or gunfire testing, burst pressures, bonfires, operation cycling, temperature testing, high temperature testing, low temperature testing, temperature cycling testing, severe abuse/accident response, and fatigue, and the like. This patent provides a solution to the sealing problems associated with traditional refrigerants, and compressors. Compressor and refrigerant systems of the present invention overcome the sealing issues by enabling new materials of construction in conjunction with an electrochemical compressor that utilizes hydrogen in the working fluid.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. An electrochemical system comprising:

an electrochemical compressor connected to an electrical power supply at a potential and through which a working fluid that includes a component that primarily acts as an electrochemically-active component flows, and comprising:

an inlet;

an outlet;

one or more electrochemical cells, each electrochemical cell comprising:

an anode connected to the electrical power supply, a cathode connected to the electrical power supply, and an electrolyte disposed between and in intimate electrical contact with the cathode and the anode to pass at least a portion of the working fluid between the anode to the cathode;

wherein the working fluid at a first pressure is pumped through the electrolyte by an electrical potential across the anode and cathode to produce a working fluid at a second pressure that is at a higher pressure than said first pressure;

a sealed rigid vessel having an interior volume in which the electrochemical compressor is housed, and comprising:

a vessel wall;

an input opening in said vessel wall;

wherein an inlet conduit extends through the inlet opening and an inlet flow of working fluid flow therethrough to the electrochemical compressor;

an output opening in said vessel wall;

wherein an outlet conduit extends through the outlet opening and an outlet flow of working fluid flow therethrough to the electrochemical compressor;

wherein the inlet flow of working fluid is at a first pressure and wherein the outlet flow of working fluid is at a second pressure that is greater than the first pressure.

2. The electrochemical system of claim 1, wherein the vessel wall is a polymeric wall, wherein a wall thickness is at least 90% polymer.

3. The electrochemical system of claim 2, wherein the polymer of the polymer wall is a fluoropolymer.

4. The electrochemical system of claim 2, wherein the polymer of the polymer wall is a thermoset polymer.

5. The electrochemical system of claim 2, wherein a surface of the polymer wall is metallized.

6. The electrochemical system of claim 2, wherein an interior surface of the polymer wall is metallized.

7. The electrochemical system of claim 1, wherein the vessel wall is a composite polymeric wall having reinforcing material configured at least partially within the wall.

8. The electrochemical system of claim 7, wherein the reinforcing material comprises fibers.

9. The electrochemical system of claim 1, wherein the inlet and the outlet conduit is a metal conduit that is brazed with a brazing material to the sealed rigid vessel.

10. The electrochemical system of claim 9, wherein metal conduit is brazed with a brazing material to the sealed rigid vessel to create a sealed surface between the metal conduit and the sealed rigid vessel, and wherein the sealed surfaces comprise chromium.

11. The electrochemical system of claim 10, wherein the chromium is plated onto the sealed rigid vessel prior to the metal conduit being brazed thereto.

12. The electrochemical system of claim 10, wherein the brazing material comprises an aluminum alloy.

13. The electrochemical system of claim 10, wherein the brazing material comprises an aluminum alloy comprising aluminum and silicon.

14. The electrochemical system of claim 10, wherein the sealed surface contains no zinc.

15. The electrochemical system of claim 1, further comprising a leak sensor at least partially configured within the interior of the sealed rigid vessel to detect a concentration of the working fluid within the interior volume of the sealed rigid vessel; and further comprising an alarm and wherein the leak sensor is coupled with a control system that activates said alarm when the concentration of the working fluid is above an upper threshold value.

16. The electrochemical system of claim 1, further comprising a leak sensor at least partially configured within the interior of the sealed rigid vessel to detect a concentration of the working fluid within the interior volume of the sealed rigid vessel; wherein the leak sensor is coupled with a control system and wherein the control system changes the potential across the anode and cathode when the leak sensor detects a working fluid concentration that is above an upper threshold level.

17. The electrochemical system of claim 16, wherein the control system shuts down the electrochemical compressor when after a delay time and the concentration of the working fluid is still above an upper threshold value.

18. The electrochemical system of claim 1, wherein sealed rigid vessel comprises an outer vessel wall and an inner vessel wall and a void space between the first and second walls.

19. The electrochemical system of claim 18, further comprising a leak sensor at least partially configured within the void space to detect a concentration of the working fluid within the void space; and further comprising an alarm and wherein the leak sensor is coupled with a control system that activates said alarm when the concentration of the working fluid is above an upper threshold value.

20. The electrochemical system of claim 1, further comprising a leak sensor at least partially configured within the interior of the sealed rigid vessel to detect a concentration of the working fluid within the interior volume of the sealed rigid vessel;

wherein the leak sensor is coupled with a control system and wherein the control system changes the potential across the anode and cathode when the leak sensor detects a working fluid concentration that is above an upper threshold level; and wherein the control system shuts down the electrochemical compressor after a delay time and the concentration of the working fluid is still above an upper threshold value.

* * * * *